US006029484A

United States Patent [19]

Jetton

[11] Patent Number: 6,029,484

[45] Date of Patent: Feb. 29, 2000

[54] SECURE DOOR HANDLE

[76] Inventor: James E. Jetton, 3863 Royal La., Dallas, Tex. 75229

[21] Appl. No.: 09/207,066

[22] Filed: Dec. 7, 1998

[51] Int. Cl.[7] ..... E05B 9/04

[52] U.S. Cl. ..... 70/371; 70/224; 70/416; 70/452; 70/DIG. 58; 292/348; 292/357

[58] Field of Search ..... 70/370, 371, 381, 70/416, 417, 452, 215, 224, DIG. 58; 292/347, 348, 350, 351, 356, 357

[56] References Cited

U.S. PATENT DOCUMENTS

| | | | |
|---|---|---|---|
| 2,655,398 | 10/1953 | Birbaum | 70/452 X |
| 3,413,829 | 12/1968 | Russell | 70/371 X |
| 4,074,915 | 2/1978 | Saffer | 292/262 |
| 4,095,445 | 6/1978 | Storlie et al. | 70/215 |
| 4,470,566 | 9/1984 | Fitzgerald | 244/129.5 |
| 4,487,440 | 12/1984 | Beijer | 292/336.3 |
| 4,510,779 | 4/1985 | Ahad | 70/208 |
| 4,560,123 | 12/1985 | Sealey et al. | 244/129.5 |
| 4,604,879 | 8/1986 | Neary et al. | 70/224 |
| 4,720,065 | 1/1988 | Hamatani | 244/129.5 |
| 4,869,083 | 9/1989 | DeMarseilles et al. | 70/224 |
| 4,991,414 | 2/1991 | Moore et al. | 70/215 |
| 5,038,588 | 8/1991 | Hall | 70/417 X |
| 5,077,994 | 1/1992 | Trull et al. | 70/371 X |
| 5,156,359 | 10/1992 | Noble et al. | 244/129.4 |
| 5,265,924 | 11/1993 | Kim | 292/357 X |
| 5,291,767 | 3/1994 | Weindorf, Jr. et al. | 70/371 X |
| 5,322,333 | 6/1994 | Norton, II et al. | 292/357 X |
| 5,398,531 | 3/1995 | Shen | 70/224 |
| 5,732,578 | 3/1998 | Kang | 70/224 |
| 5,761,936 | 6/1998 | Katayama | 70/370 X |
| 5,782,119 | 7/1998 | Ellis et al. | 70/371 |
| 5,809,815 | 9/1998 | Lee | 70/224 X |
| 5,813,708 | 9/1998 | Shen | 70/224 X |
| 5,862,690 | 1/1999 | Jancsek | 70/224 |

*Primary Examiner*—Suzanne Dino Barrett
*Attorney, Agent, or Firm*—Roberts Abokhair & Mardula, LLC

[57] ABSTRACT

A door handle assembly is described comprising a mounting base, a cover plate, an inner cylinder and a lock mechanism wherein the cover plate covers the means for attaching the handle assembly to a door. The handle or grip holds the cover plate in place and the lock mechanism holds the handle in place. The handle assembly cannot be removed without the removal of the lock mechanism.

9 Claims, 2 Drawing Sheets

SECURE DOOR HANDLE

BACKGROUND OF THE INVENTION

The present invention relates to an improved door handle. The improved door handle is specifically applicable in the aviation industry for use in the doors to the main cabin of an small aircraft or other doors where security is a concern. More specifically, the present invention relates to a secure door handle having a mounting mechanism that is not accessible from the outside without the lock key.

In small aircraft, one of the more common concerns is vandalism and access to the aircraft while parked on the tarmac. These aircraft, such as the Raytheon-BeechCraft King Air Series aircraft, have existing handles that are mounted on the doors with screws that are accessible from the outside. A person can enter the aircraft without having a key to the lock by simply removing the three accessible philips head screws which would then allow the handle to be turned and the door opened. Any unauthorized access to the aircraft may result in theft of personal belongings, headsets, or avionics. Tampering with the equipment is also an issue. The concerns range from delay of flight due to lost avionics or tampering to safety concerns and terrorism.

Further, some internal cabinets or storage compartments may need to be locked without allowing access without a key. Handles and locks that can be removed from the outside with other tools, such as a screwdriver, do not provide the needed safety and security.

The present invention relates to improvements in the handle mechanisms, particularly in aircraft applications, by providing a secure handle that cannot be tampered with without having the key to the lock on the handle. More particularly, the lock on the handle serves two purposes: to secure the handle from being removed from the door, and to operate the opening or closing of the door.

SUMMARY OF THE INVENTION

It is an object of the invention to provide a secure handle assembly with a locking mechanism where the handle cannot be removed from the outside without the key or without significant damage to the applicable door.

It is another object of the invention to provide a handle assembly with a locking mechanism that will replace existing handles on certain aircraft.

Another object of the present invention is to provide a method for reducing the ease of tampering with or vandalism of small aircraft.

One embodiment of the present invention provides a handle assembly for actuating a door latch mechanism. The assembly comprises a mounting base including means of attaching the base to the door, an actuating shaft extending from the handle to operate the existing door latching mechanism, a cover around the base of the shaft and mounting base, covering the mounting mechanism and the base, a handle that secures the cover in place and operates to turn the latching mechanism, and a locking mechanism mounted to the handle to secure the handle in place and to control operation of the handle. The lock and handle are applied to the assembly in a manner to prevent the removal of the handle, and thus the cover plate, without the key to the lock.

DESCRIPTION OF THE PREFERRED EMBODIMENT

The present invention provides a handle assembly including a lock. The lock can be any type but is preferably a plunger type lock. Such locks are available from various vendors in the United States. The lock is operated with a key that can be removed from the lock in both the locked and unlocked positions.

The handle, mounting base and cover are made from solid material that is resistant to tampering. This includes various plastic materials, metals and various alloys. In addition to toughness, lighter weight material is preferred. Aluminum alloys exhibit all the desired toughness, weight and machining properties and are preferred.

In one embodiment of the present invention, the plunger lock and its shell are fit into an inner cylinder that includes the actuating shaft. The mounting base and the inner cylinder are held together using various known means such as a snap ring, a lock pin, a brad or the like to form the main housing for the handle assembly. The cover plate fits over the main housing unit and around the inner cylinder. The handle is placed over the inner cylinder to hold the cover plate in place and the lock is subsequently inserted into the inner cylinder through the handle. The lock mechanism holds the handle in place.

Figure 1:
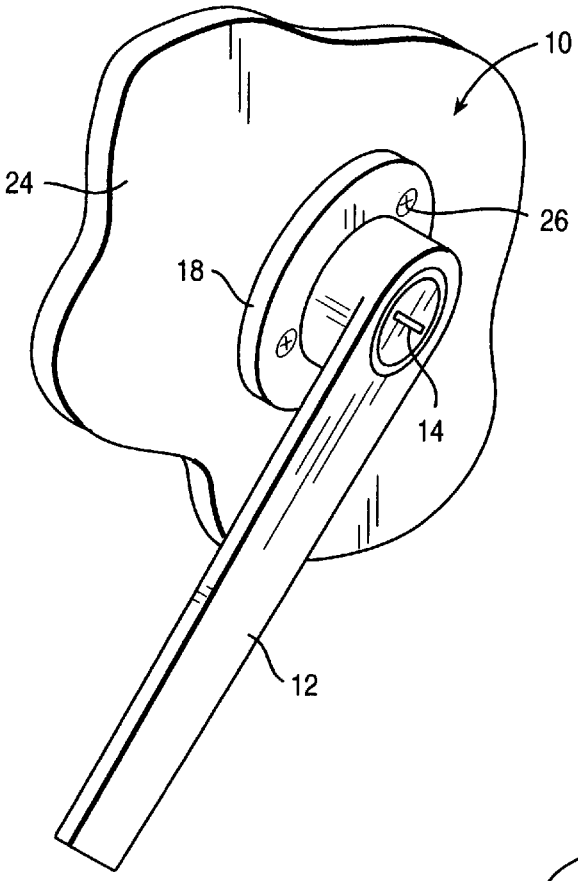
FIG. 1 PRIOR ART
FIG. 1 is a perspective view of the existing handle that shows the three mounting screws.

As is shown in FIG. 1, the factory handle on the main cabin door of a King Air aircraft can be removed be removing the screws 26 and pulling the whole handle assembly off.

Figure 2:
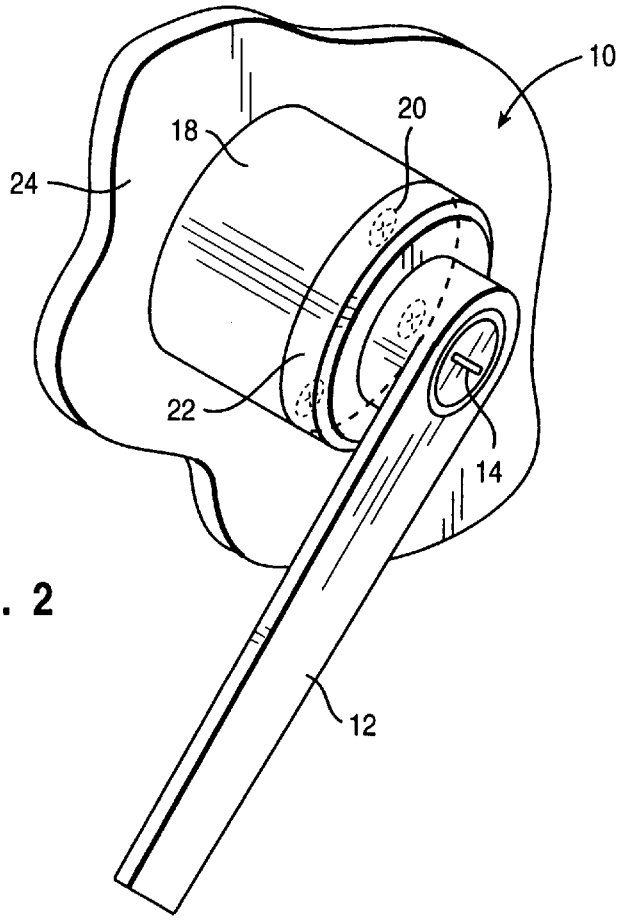
FIG. 2 is a partial perspective of an aircraft door incorporating a secure locking handle assembly in accordance with one embodiment of the present invention.

FIG. 2 shows the replacement handle in accordance with one embodiment of the present invention. The handle fits into the same slot as the original equipment with the exception that the handle assembly screws are covered by the cover plate 22.

Figure 3:
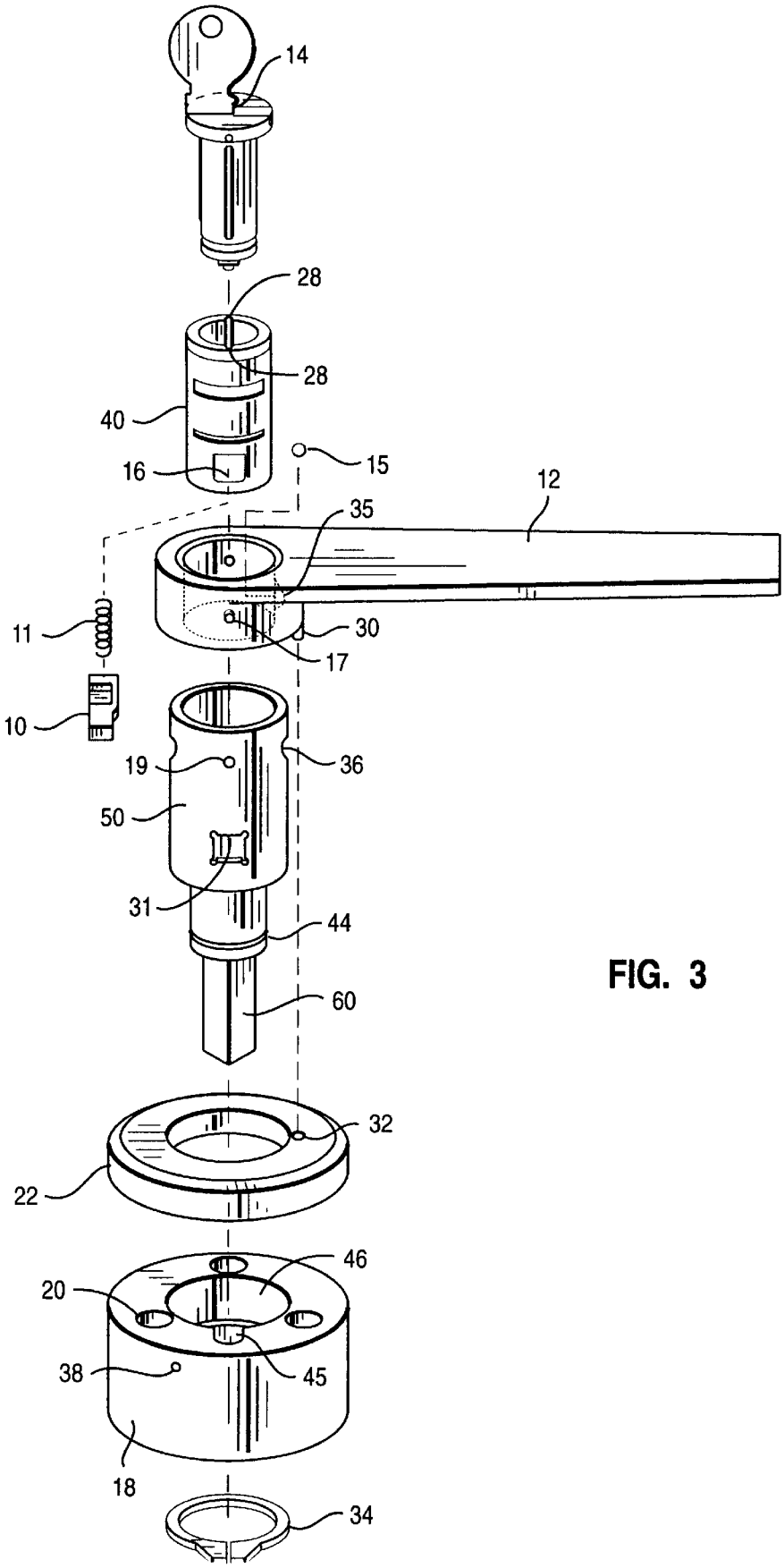
FIG. 3 shows the various parts of one embodiment of the present invention.

As shown in FIG. 3, the handle is made up of several parts including, a mounting base 18, an inner cylinder 50 including a center actuating shaft 60, a cover plate 22, a grip or handle 12, and a lock 14. The mounting base 18 includes a pin hole 38 that goes through the side of the mounting base 18 in a position to face the lock plunger 10. Screw holes 20 are drilled through the mounting base 18 to accommodate the mounting screws of the original equipment. The location of the screw holes can be changed to accommodate various makes of aircraft or new holes can be drilled into the aircraft doors. The matching of these holes to the original equipment manufacturer locations is for the convenience of installation and replacement of the handle assembly. A notch 45 is made into the inner wall 46 of the mounting base 18 to accommodate the lock plunger 10 and aligned with hole 31 of the inner cylinder 50. The inner surface 46 of the mounting base 18 is shaped to accommodate the bottom half of the inner cylinder 50. The actuating shaft 60 and the snap ring grove 44 extend below the lower face of mounting base 18. When put together, the actuating shaft 60 and the snap ring groove 44 extend below the lower face of mounting base 18 and are held in place by snap ring 34. The inner cylinder and mounting base may be held together by various means such as a lock pin, a regular pin, various brads and the like.

The inner cylinder 50 comprises opening 31 which accommodates plunger 10 and aligns with notch or groove 45. One or two holes 36 are drilled to the side to accommodate the ball bearing or other means for holding the handle down. Grooves or indentations 19 are positioned to accommodate set screws 17 in the handle.

The inner cylinder and the mounting base are put together. The cover plate 22 is placed around the inner cylinder and over the mounting base to cover the screw holes 20. The cover plate 22 includes hole 32 that accommodates the short roll pin 30 of the handle. This connection of the handle to the cover plate is not essential to the present invention but allows for a more sturdy construction of the handle assembly.

The handle 12 is placed around the inner cylinder and over the cover plate 22. On the inner surface of the handle, a groove, notch or semi spherical indentation 35 is formed. This serves to hold the pin or ball bearing through holes 36 of the inner cylinder. For example, holes 36 and receptacle 35 are shaped to accommodate a ball bearing. The ball bearing prevents the movement of the handle relative to the inner cylinder after the lock shell 40 is placed inside the inner cylinder. A key aspect of the present invention is once the lock is in place, the handle cannot be removed without removal of the lock mechanism. Other means of fixing the movement of the handle relative to the inner cylinder can be employed. For example, a brad, a pin, various screws or even a nail may be employed. The objective is fixing the movement of the handle relative to the inner cylinder where the handle cannot be removed from the inner cylinder. In this embodiment, the position of the holes 36 and the receiver 35 are such that the key lock shell 40 fits flush against the holes 36 to hold the ball bearing or pin in place. Two set screws 17 are be utilized to further strengthen the position of the handle. It should be noted that the handle cannot be removed from the handle assembly if the set screws are removed.

The plunger lock 14 is fitted through the lock shell 40. A preferred lock type includes a spring loaded plunger 10. The spring 11 holds the plunger 10 in position. The shell has two grooves 28 to allow the removal of the key from the lock in both the locked and unlocked positions. The plunger 10 extends through the shell from opening 16. The lock and the shell are inserted through the handle into the inner cylinder 50 so that the plunger 10 is aligned with openings 31 and 45. The plunger 10 extends through opening 31 in both the locked and unlocked positions. In the locked position, the handle assembly cannot be taken apart. In the unlocked position, the plunger fits through opening 31 but not through opening 45. Thus, the mechanism can be rotated so that the plunger faces hole 38. A small rod, such as a straightened paper clip, is inserted through hole 38 to push the plunger behind opening 31 to allow the removal of the lock. Once the lock is removed, the whole handle can be disassembled.

Once the handle is assembled on the door, the handle mounting screws are inaccessible, but the assembly works the same as the original handle with respect to the operation of opening the door. The handle assembly is locked or unlocked with a key and the handle is allowed to turn to operate the door mechanism.

Although the description above contains many specificities, these should not be construed as limiting the scope of the invention, but as merely providing illustrations of some of the presently preferred embodiments of this invention. Various other embodiments and ramifications are possible within its scope. For example, the handle assembly can be attached to doors other than the main cabin door on an aircraft. Various means for holding together the inner cylinder and the base may be employed. The shape of the cover plate can be modified in addition to the means for attaching the handle assembly to a door.

Thus the scope of the invention should be determined by the appended claims and their legal equivalents, rather than by the examples given.

I claim:

1. A handle assembly for actuating a door latch mechanism comprising:

a mounting base including means of attaching the mounting base to a door;

an inner cylinder including an actuating shaft to operate the door latching mechanism;

a cover over the mounting base;

a handle that secures the cover in place and operates to turn the latching mechanism; and a locking mechanism mounted to the handle to secure the handle in place an to control operation of the handle, wherein disassembly of the handle assembly requires the removal of the locking mechanism.

2. The handle assembly of claim 1, wherein the door latch mechanism is to an aircraft main cabin door.

3. A door handle assembly comprising:

a lock having a lock cylindrical shell and a plunger mechanism;

a mounting base comprising an inner wall and an outer wall, a pin hole in one side in a position to face the plunger mechanism of the lock, and a notch in the inner wall to accommodate the plunger mechanism;

an inner cylinder including a center actuating shaft and a hole in one side to accommodate the plunger mechanism of the lock;

a cover plate; and a handle;

wherein the inner wall of the mounting base accommodates half of the inner cylinder; and wherein the lock cylindrical shell comprises means to hold the handle in place wherein the removal of the handle requires the removal of the lock from the lock cylindrical shell and the removal of the shell from the handle mechanism.

4. The handle assembly of claim 3 wherein the mounting base comprises at least two holes drilled through the base as guides for the means to mount the base to a door.

5. The handle assembly of claim 3 wherein the inner cylinder further comprises a hole matching with a reciprocal hole or indentation in the handle and wherein a ball bearing is used to extend from said inner cylinder hole to the handle and wherein said ball bearing is held in place by the lock shell.

6. The handle assembly of claim 3 wherein the inner cylinder is attached to the mounting base with a snap ring below the bottom surface of the mounting base.

7. The handle assembly of claim 3 wherein said door is an aircraft door.

8. A door handle assembly comprising a handle, a lock, a mounting base, and a mounting base cover wherein, the mounting base comprises means for attaching the handle assembly to the door, the mounting base cover precludes access to the means for attaching the handle assembly to the door, the handle blocks the removal of the mounting base cover, and wherein the removal of the handle requires the removal of the lock from the handle.

9. The door handle assembly of claim 8 wherein the lock is operated with a key and the lock is attached to the handle assembly with means to prevent the removal of the lock without the key.

* * * * *